US009394149B2

(12) United States Patent
Karlsson

(10) Patent No.: US 9,394,149 B2
(45) Date of Patent: Jul. 19, 2016

(54) SIDE LIFT SPREADER

(71) Applicant: ELME SPREADER AB, Älmhult (SE)

(72) Inventor: Gösta Karlsson, Killeberg (SE)

(73) Assignee: ELME SPREADER AB, Almhult (SE)

( * ) Notice: Subject to any disclaimer, the term of this patent is extended or adjusted under 35 U.S.C. 154(b) by 41 days.

(21) Appl. No.: 14/377,989

(22) PCT Filed: Feb. 19, 2013

(86) PCT No.: PCT/EP2013/053275
§ 371 (c)(1),
(2) Date: Aug. 11, 2014

(87) PCT Pub. No.: WO2013/124271
PCT Pub. Date: Aug. 29, 2013

(65) Prior Publication Data

US 2015/0030422 A1 Jan. 29, 2015

(30) Foreign Application Priority Data

Feb. 20, 2012 (EP) ..... 12156153
Feb. 20, 2012 (EP) ..... 12156154
Feb. 20, 2012 (EP) ..... 12156155

(51) Int. Cl.
*B66F 9/16* (2006.01)
*B66C 1/10* (2006.01)
*B66F 9/18* (2006.01)

(52) U.S. Cl.
CPC . *B66F 9/16* (2013.01); *B66C 1/101* (2013.01); *B66F 9/186* (2013.01)

(58) Field of Classification Search
CPC ..... B66F 9/16; B66F 9/186; B66F 9/18; B66F 9/125; B66F 9/183; B66C 1/101
USPC ..... 414/620, 621; 294/81.4
See application file for complete search history.

(56) References Cited

U.S. PATENT DOCUMENTS 3,499,563 A 3/1970 Forry et al.
3,589,540 A * 6/1971 Kinross ..... B66F 9/186 294/81.4

(Continued)

FOREIGN PATENT DOCUMENTS

DE 3007901 A1 9/1981
GB 1145175 A 3/1969

(Continued)

OTHER PUBLICATIONS

International Search Report for PCT/EP2013/053275, ISA/EP, Rijswijk, NL, mailed Apr. 25, 2013.

(Continued)

*Primary Examiner* — Kaitlin Joerger
(74) *Attorney, Agent, or Firm* — Harness, Dickey & Pierce, PLC

(57) ABSTRACT

A side lift spreader for handling empty containers, and method for adjusting a main frame of an inverted side lift spreader. The inverted side lift spreader comprises a main carriage connectable to a lifting device, movable along a front side of a mast of the lifting device, the main frame being carried by and sideways movable with respect to the main carriage, and main frame guiding means for guiding movement of the main frame with respect to the main carriage. The main frame guiding means comprises at least two links, one first portion of each link connected to the main frame and one second portion of each link connected to the main carriage. The second portions of the links are arranged at the main carriage at respective points of attachment which are located, in use of the spreader, at an opposite side of the mast compared to the front side.

12 Claims, 8 Drawing Sheets

(56) References Cited

U.S. PATENT DOCUMENTS

| | | | | | |
|---|---|---|---|---|---|
| 3,633,777 | A | * | 1/1972 | Snelling, Jr. | B66F 9/186 294/81.4 |
| 3,750,814 | A | * | 8/1973 | Allegri | B66F 9/19 294/81.21 |
| 3,752,346 | A | * | 8/1973 | Thompson | B66F 9/186 294/81.21 |
| 4,449,882 | A | * | 5/1984 | Perrott | B66F 9/186 294/81.2 |
| 4,482,285 | A | * | 11/1984 | Copie | B66F 9/186 294/81.4 |

FOREIGN PATENT DOCUMENTS

| | | | |
|---|---|---|---|
| JP | H01-78696 | U | 5/1989 |
| JP | H03-138299 | A | 6/1991 |
| JP | H06-298498 | A | 10/1994 |

OTHER PUBLICATIONS

International Search Report for PCT/EP2013/053275, Geneva, CH; mailed Sep. 4, 2014.

* cited by examiner

SIDE LIFT SPREADER

CROSS REFERENCE TO RELATED APPLICATIONS

This application is a 371 U.S. National Stage of International Application No. PCT/EP2013/053275, filed Feb. 19, 2013. This application claims priority to European Patent Applications Nos. 12156155.9, filed Feb. 20, 2012, 12156154.2, filed Feb. 20, 2012, and 12156153.4, filed Feb. 20, 2012. The entire disclosures of the above applications are incorporated by reference herein.

FIELD OF THE INVENTION

The present invention relates to a side lift spreader for handling empty containers. The side lift spreader comprises a main carriage which is connectable to a lifting device to be movable along a mast of the lifting device, a main frame which is carried by and sideways movable with respect to the main carriage, and main frame guiding means for guiding a movement of the main frame with respect to the main carriage.

BACKGROUND OF THE INVENTION

Side lift spreaders are commonly used for handling empty containers. Two horizontal telescopic beams allow containers of varying size to be handled by one spreader. Each telescopic beam is provided with a container locking device, commonly a twist lock or a lifting hook, that should mate with corner castings in the upper corners of the container. A main frame of the spreader holds the telescopic beams. The main frame is supported by and slidable in a guide cradle. The guide cradle is, in turn, held by a main carriage which is connected to a lifting device, such as a truck. Thus, the entire spreader and the container are movable by lifting along a mast of the truck. A common type of side lift spreader is shown in EP 0 701 964.

Empty containers may be stacked on top of each other on rather high container stacks. In recent years it has become common to use stacks of heights up to nine regular containers, which corresponds to 22.5 metre high stacks. It is difficult for the operator of the truck to control the position of the container and/or the spreader at such high levels. In particular it is difficult for the operator of the truck to align the locking device of the spreader with the with corner castings of the container at high levels. Moreover the mast may tend to flex somewhat at high levels which further render control of the spreader more difficult.

There is a need for an improved side lift spreader which in particular is suitable for lifting and handling empty containers at high stacks.

SUMMARY OF THE INVENTION

According to a first inventive concept, a first aspect relates to a side lift spreader for handling empty containers, comprising a main carriage which is connectable to a lifting device to be movable along a mast of the lifting device, a main frame which is carried by and sideways movable with respect to the main carriage, and main frame guiding means for guiding a movement of the main frame with respect to the main carriage, wherein the main frame guiding means comprises at least two links, one first portion of each link being connected to the main frame and one second portion of each link being connected to the main carriage. "Link" may be a rigid link arm such as a rod, push rod or cylinder. "Link" may also be a non-rigid link such as a wire or chain which then may be used together with one or several support members to restrain the main carriage from approaching the main carriage or other portions of the spreader in a non desired manner.

An advantage of the side lift spreader is that the links allow the main frame to be guided with respect to the main carriage without any intermediate construction which saves weight and thus reduces the total weight of the spreader. The reduced weight of the spreader may directly affect the stability of the mast at high lifting heights. Alternatively the reduced weight of the spreader may allow other parts or components of the spreader to be arranged for instance to support the mast at high lifting heights. Moreover, the service intervals of the spreader may be extended since friction pads, which are used in prior art side lift spreaders, may not be necessary in the spreader according the present invention.

The side lift spreader is suitable for being movable along a mast of a lifting device. The main frame may be sideways movable with respect to main carriage.

Preferably the links are pivotal links. Having pivotal links for guiding the movement of the main frame with respect to the main carriage may reduce the friction between the main carriage and the main frame which reduces the energy required to move the main frame with respect to the main carriage.

In one embodiment the links are rigid links. Rigid links may be easier to control than non-rigid links.

In one embodiment the side lift spreader comprises at least three links, or at least four links. If four links are used, two of the links may be upper links and two of the links may be lower links. If four links are used, the links may be arranged as parallelogram links which may give favourable guiding abilities.

The links may be horizontally operating links. "Horizontally operating link" does not necessarily mean that the link is arranged completely horizontally, but that the link is arranged to move the main frame with respect to the main carriage in a direction which is mainly a horizontal direction. Such links may effectively move the main frame with respect to the main carriage in a horizontal direction without, or with very little, friction between the main frame and the main carriage.

In one embodiment at least one of the links comprises a tilt cylinder operable for tilting the container. By "tilt" is meant a rotation of the container about the x-axis, provided that the container is arranged in a xyz-coordinate system, having the long side of the container in an xz-plane, the short side of the container in an yz-plane, and the bottom of the container a xy-plane. Another definition the "tilt" of a container is given by reference to the directions of rotation of a container arranged on a cargo ship. Containers arranged on a cargo ship are aligned with the cargo ship having the container long side along the length of the cargo ship. The rotational motions of the container may therefore be defined by reference to the motions of the cargo ship, i.e. list, trim and skew. List corresponds to the tilt rotation. Trim will herein be referred to as sideways leaning of the container.

Having a tilt cylinder allows convenient control of the tilt of the container. If a container should be placed on a high stack of containers and the mast of the truck is deflected due to the high lifting height, the tilt cylinder could be used to compensate for the deflecting mast and thus aligning the container with the stack of containers. It may be useful to tilt the container also at ground level, for instance if the container should be placed, or is placed, at a sloping surface.

In one embodiment the main carriage is movable along a front side of the mast, wherein the second portions of the links are arranged at the main carriage at respective points of attachment which are located, in use of the spreader, at an opposite side of the mast compared to the front side. The links are extended between points of attachment on the main frame and main carriage, respectively. A distance between main frame and the points of attachment on the main carriage may allow efficient guidance the main frame movement. By front side of the mast is meant the side of the mast facing the container in use of the spreader. By opposite side of the mast is meant the side opposite the front side, i.e. the side which faces way from the container in use of the spreader. Since the links are provided between points of attachment on the main frame and points of attachment on the main carriage, the links may provide a distance between the main frame and the points of attachments of the links on the main carriage. Such distance, which basically may correspond to the length of the links, may allow efficient guidance of the main frame movement with respect to the main carriage.

In one embodiment, at least one of the links is a vertically operating cylinder operable for adjusting the sideways leaning of the main frame with respect to the main carriage. The movement which is referred to "sideways leaning" is defined above. Using the coordinate system described above sideways leaning is a rotation of the container about the y-axis. The vertically operating cylinder may be a so called PPS (Powered Pile Slope) cylinder. "Vertically operating cylinder" does not necessarily mean that the cylinder is arranged completely vertically. However work performed by the vertically operating cylinder affects the vertical position of the main frame and the container.

In one embodiment, the main frame is supported by the vertically operating cylinder. Two vertically operating cylinders may be used to increase the stability and make controllability of the spreader.

Preferably, the side lift spreader comprises at least two vertical container holding beams which are arranged to the main frame, wherein each vertical container holding beam comprises a container locking device and a lower container support, wherein the lower container support is arranged at a longer vertical distance from the main frame than the container locking device. A reference point at the main frame should be used when measuring the vertical distance to the lower container support and the container locking device, respectively. The same reference point should be used for the lower container support and the container locking device that are located on the same vertical container holding beam. The reference point should be located at the main frame itself and in particular the reference point should not be located at any downwardly projecting portion attached to the main frame. The main frame is the construction arrangement which holds the vertical container holding beams that are equipped with the container locking devices. The main frame may also hold horizontal beams which may be telescopically in order for the spreader to be adjustable and lift containers of different sizes. If such horizontal beams are used, the vertical container holding beams are arranged on the horizontal beams. The main frame is movable with respect to the main carriage in order for the container locking devices, which may be twist locks or lifting hooks, to be mated with locking devices of the container, such as corner castings in the upper corners of a container.

In prior art side lift spreaders, such as the side lift spreader illustrated in EP 0 701 964, the container locking means, i.e. the twist locks, are located at vertical container holding beams extending upwards from the main frame. Thus, in prior art side lift spreaders the operator or the spreader, which is usually the driver of the truck, may have difficulties of aligning the locking devices of the spreader with the container to be lifted since the main frame of the spreader obstructs the view of the locking devices. The present side lift spreader overcomes this problem, at least partially, by arranging container locking devices at a shorter distance from the main frame than in the prior art side lift spreaders. Preferably the container locking devices are arranged below the main frame to optimize the container locking device view for the operator of the spreader.

A second aspect of the first inventive concept relates to a method for adjusting a main frame of an inverted side lift spreader with respect to a main carriage of the inverted side lift spreader, comprising supporting the main carriage at a mast of a lifting device; supporting the main frame movably at the main carriage; and guiding a movement of the main frame with respect to the main carriage using main frame guiding means comprising at least two pivotal links. The movement may be a sideway translation of the main frame with respect to the main carriage. By sideway translation is meant a side shift movement where the main frame is moved sideways movement with respect to the main carriage in a direction parallel with the length of a container which may be connected to the spreader. The movement may also be a sideway leaning of the main frame with respect to the main carriage, or both a sideway translation and a sideway leaning of the main frame with respect to the main carriage.

According to a second inventive concept, a first aspect relates to a side lift spreader for handling empty containers comprising a main carriage which is connectable to a lifting device to be movable along a mast of the lifting device, a main frame which is arranged to the main carriage, and at least one container support which is arranged to the main frame, wherein the side lift spreader comprises at least one tilt cylinder for moving said container support with respect to the main carriage to tilt the container. The side lift spreader is suitable for being movable along a mast of a lifting device. Having a tilt cylinder allows convenient control of the tilt of the container. If a container should be placed on a high stack of containers and the mast of the truck is deflected due to the high lifting height, the tilt cylinder could be used to compensate for the deflecting mast and thus aligning the container with the stack of containers. It may be useful to tilt the container also at ground level, for instance if the container should be placed, or is placed, at a sloping surface.

The container support may be a locking device which holds a container at the spreader, such as a so called twist lock or a lifting hook. Lifting hooks may be used together with so called side flippers that support the sides of the container. It is also possible to use locking devices adapted for double handling, i.e. lifting two containers placed on top of each other. Such systems are known in the art and will not be described here. The container support may also be a support surface of the spreader which supports the container but which does not hold the container. In addition the container support may refer to a vertical container holding beam. The side lift spreader comprises at least two tilt cylinders. Two tilt cylinders may facilitate control of the spreader.

One first portion of each tilt cylinder described above may be connected to the main frame and one second portion of each tilt cylinder may be connected to the main carriage. If the tilt cylinders are connected to the main carriage and to the main frame of the spreader the tilt cylinders may be utilized for other purposes than tilting the container, such as guiding of the main frame with respect to the main carriage.

The container support may be a lower container support arranged on a vertical container holding beam arranged to the main frame, wherein the vertical container holding beam comprises a container locking device, and wherein the lower container support is arranged at a longer vertical distance from the main frame than the container locking device.

A second aspect of the second inventive concept relates to a method for tilting a container handled by a side lift spreader by having a main carriage which is movable along a mast of a lifting device, comprising arranging the container to a container support means of the side lift spreader; moving the container using the side lift spreader; tilting the container with respect to the main carriage using at least one tilt cylinder arranged on the side lift spreader. The tilted container may then be placed on a storage surface such as on the ground or on a pile of containers. The storage surface may be tilted with respect to the lifting device. Thus, the method of tilting the container provides improved handling of a container which should be place on, or lifted from, a sloping or tilting surface.

A third inventive concept relates to a side lift spreader for handling empty containers comprising a main carriage which is connectable to a lifting device to be movable along a mast of the lifting device, a main frame which is carried by the main carriage, and at least two vertical container holding beams which are arranged to the main frame, wherein each vertical container holding beam comprises a container locking device and a lower container support, wherein the lower container support is arranged at a longer vertical distance from the main frame than the container locking device.

A lower portion of the vertical container holding beam comprises the container support and an upper portion of the vertical container holding beam comprises the container locking device. The vertical container holding beam projects downward from the main frame to a greater extent than it projects upward from the main frame. It is also possible that the vertical container holding beams are arranged such that both the container locking devices and the container supports are arranged below the main frame. As was mentioned above, when determining the vertical distance from the main frame to the container locking device and the vertical distance from the main frame to the lower container support, respectively, a reference point determining a horizontal reference level should be used. If the main frame holds horizontal beams, that may or may not be telescopically, such reference point should be a point on the horizontal beams. For instance the reference point may be located on the underside on the lower one of the horizontal beams, i.e. on the side of the horizontal beam facing the ground.

Alternatively, a lower container support and a container locking device may be arranged on separate vertical container holding beams, however such separate beams has the same purpose as one single beam and is therefore herein referred to as one vertical container holding beam. The container locking device may also be arranged directly on the main frame and the container support may be arranged on a vertical container holding beam. In such an embodiment the lower container support is clearly arranged at a longer vertical distance from the main frame than the container locking device.

The container locking device will from now on also be referred to as lifting hooks, which are commonly used as container locking devices for side lift spreaders. The purpose of the lifting hooks is to lock the container to the spreader. The purpose of the lower container support is to support a container at a surface of the container which is located below the lifting hooks to provide stable handling of the container. Having a lower container support arranged at a longer vertical distance from the main frame than a twist lock allows the vertical container holding beams to be projecting downwards from the main frame. For the purpose of describing the advantages of the spreader an initial position for the spreader is defined as the lowest working position of the spreader on a lifting device, such as a truck, for lifting and/or handling a container placed directly on flat ground. In the initial position of the side lift spreader according to the present invention, the main frame is located at a longer vertical distance from the ground than in prior art side lift spreaders. One advantage with the side lift spreader described above is thus that the vertical distance from the ground in the initial position may allow the spreader to be arranged above the front axle of a truck instead of in front of the front axle of the truck. The centre of mass for the spreader and the container is therefore located closer to the centre of mass for the truck, compared to prior art speeders, which increases stability of the spreader on the truck. The side lift spreader may comprise a tilt cylinder operable for tilting the container.

The side lift spreader may comprise one or several vertically operating cylinders operable for adjusting the sideway leaning of the main frame with respect to the main carriage. The movement which is referred to "sideway leaning" is defined above. The main frame may be supported by the vertically operating cylinder/s.

As is known in the art, a side lift spreader normally handles a container using two corner castings of the container, which will now be described. All eight corners of a container are usually provided with corner castings. Corner castings may also be called corner fittings. Thus, a container is usually provided with four upper corner castings, one arranged in each of the four upper corners of the container, and four lower corner castings, one arranged in each of the four lower corners of the container. Each upper corner casting usually has three openings and are thus usually accessible from three directions, i.e. from the short side of the container, from the longitudinal side of the container, and from above. A side lift spreader is arranged to handle a container by means of arranging container locking devices, such as lifting hooks or twist locks, at two upper corner castings arranged at the same longitudinal side of the container. However, since each upper corner casting may be accessible from three different directions, it is not necessary that the side lift spreader locking devices access the corner castings from the longitudinal side. It is possible that the side lift spreader locking devices access two corner castings, arranged at the same longitudinal side of the container, from above or from the short sides of the container. In other words, even though a side lift spreader approaches the container from the longitudinal side of the container it is possible that the locking devices of the side lift spreader access the corner castings from another direction, i.e. from the short sides of the container or from above. Thus, a side lift spreader lift may handle a container by arranging container locking devices at two upper corner castings of the container, and wherein the remaining two upper corner castings of the container are not used by the side lift spreader for handling the container. In this sense a side lift spreader is clearly different from a spreader that handles a container by arranging container locking devices in all four upper corner castings of the container.

BRIEF DESCRIPTION OF THE DRAWINGS

The present invention will now be described in more detail, with reference to the appended drawings showing embodiments of the present invention, in which.

DETAILED DESCRIPTION

The invention will now be described in more detail by means of examples and with reference to the accompanying drawings.

In general, the term "side lift spreader" is used for spreaders that lift containers from one longitudinal side of the container, which is described above. Container corners are normally provided with corner castings. A side lift spreader may lift a container in two upper corner castings provided in the same longitudinal side of a container, or provided in the upper side of a container along the same longitudinal side. Thus, the corner castings are accessible by a side lift spreader either from the side or from above. Side lift spreaders are normally used for handling empty containers.

Figure 1:
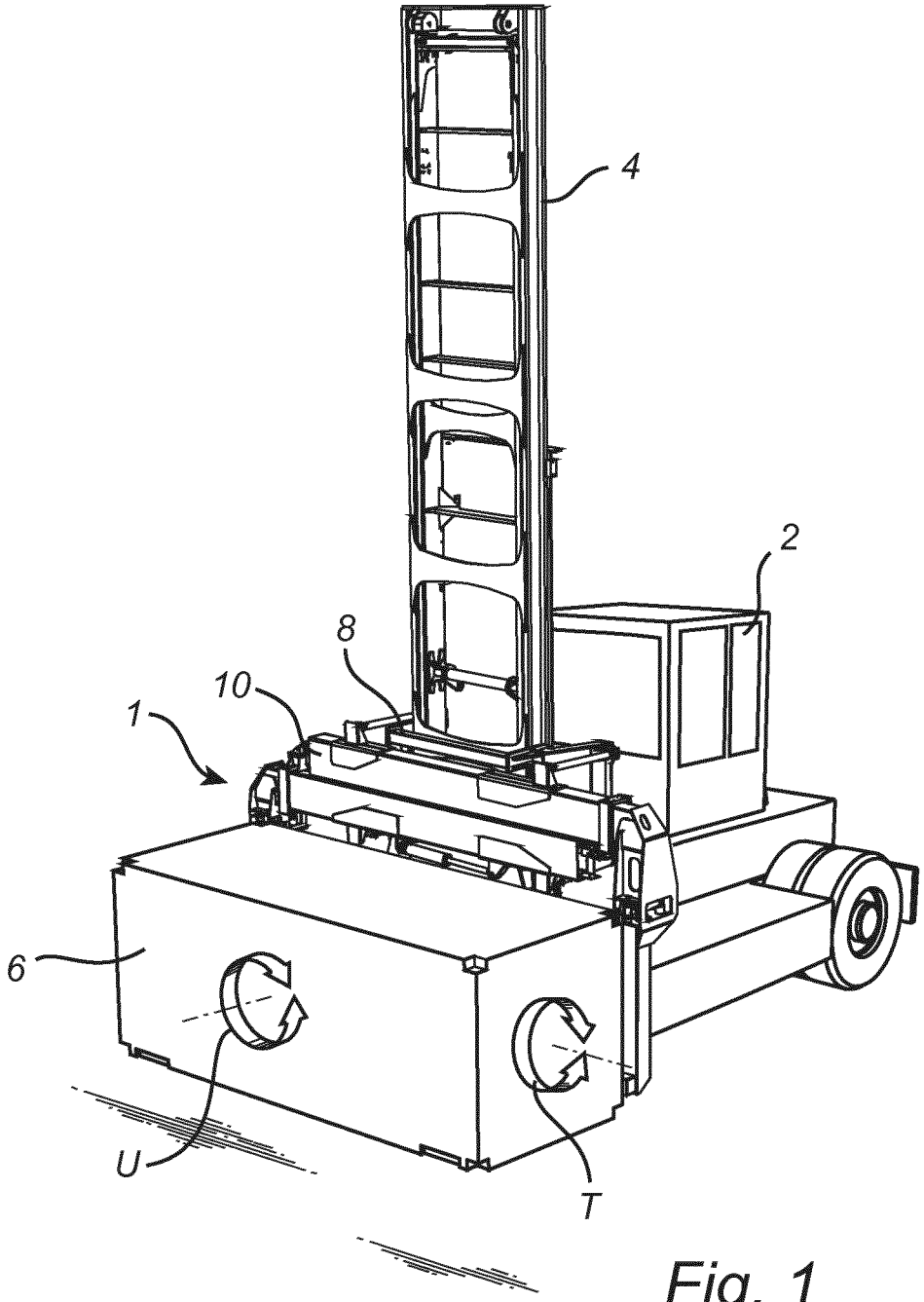
FIG. 1 is a perspective of a truck arranged with a side lift spreader handling an empty container.

FIG. 1 illustrates a side lift spreader 1 arranged on a lifting device 2, which is this case is a truck 2. The side lift spreader 1 described herein will from now on be referred to as inverted side lift spreader 1 or just spreader 1. The term inverted allude to the present spreader 1 being a new type of side lift spreader which differs from known side lift spreaders in several ways, as will be described below and seen in the drawings.

The truck 2, which is only schematically illustrated In FIG. 1, has a mast 4 along which the spreader 1 is movable for lifting an empty container 6. The spreader 1 comprises a main carriage 8 which is arranged at the mast 4 by means of known devices which are not illustrated here. The spreader 1 further comprises a main frame 10 which is movable with respect to the main carriage 8 to either adjust the position of the spreader 1 prior to engaging the container 6, or to control the position of the container 6 during lifting or handling of the container 6.

As is seen in FIG. 1, and as will be described in more detail below, the main carriage 8 is arranged in front of the mast 4 as well as at the sides of the mast 4. Prior art side lift spreaders has the main carriage arranged in front of the mast, whereas the present inverted side lift spreader 1 has its main carriage 8 arranged at three sides of the mast 4. Two directions of rotation of the container 6 is denoted in FIG. 1, i.e. the tilt direction T and the sideway leaning direction U. Tilt T is the direction where the container 6 is rotated about an axis parallel to the container long side. Sideway leaning U is the direction where the container 6 is rotated about an axis parallel to the container short sides.

Figure 2:
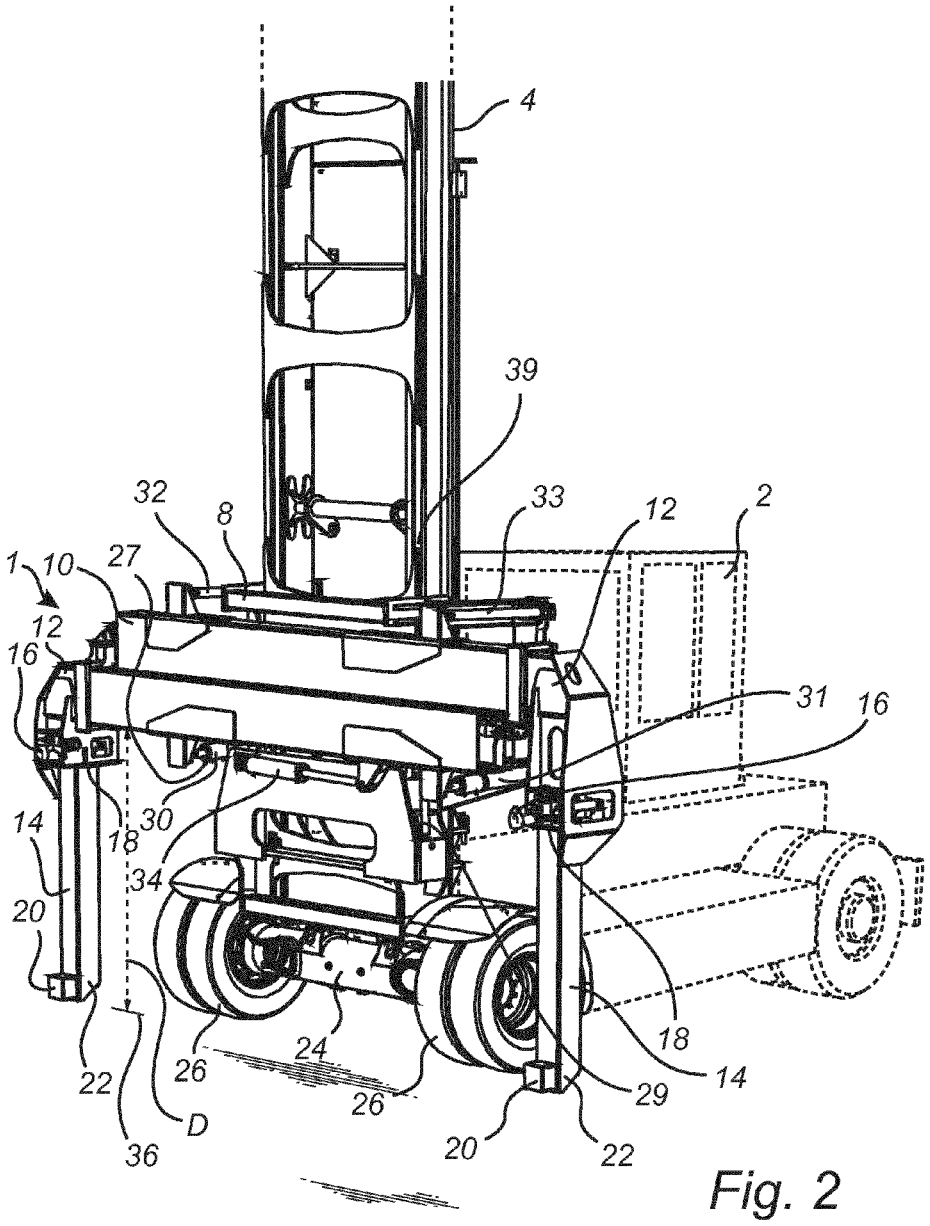
FIG. 2 is a perspective view of the side lift spreader in FIG. 1 arranged on a truck.

FIG. 2 illustrates the inverted side lift spreader 1 of FIG. 1. For clarity purposes FIG. 2 does not show any container. Two horizontal beams 12 are arranged in the main frame 10. The horizontal beams 12 are telescopically movable in the main frame 10 to allow the spreader 1 to handle containers of different sizes. A vertical container holding beam 14 is arranged at the end of each horizontal beam 12. Each vertical container holding beam 14 projects downward, i.e. towards the ground, from the horizontal beam 12, and is arranged essentially perpendicular to the horizontal beam 12. Thus, another difference between the inverted side lift spreader 1 and prior art side lift spreaders is that prior art side lift spreaders has the vertical container holding beams extending upwards from the main frame whereas the inverted side lift spreader 1 has vertical container holding beam 14 extending downwards from the main frame 10.

A container locking device 16 is arranged on each vertical container holding beam 14 in the vicinity of the horizontal beam 12, i.e. at an upper end portion 18 of the vertical container holding beam 14. The container locking device 16 shown here are so called lifting hooks, which are commonly used as container locking devices 16. Thus, the container locking devices will from now on be referred to as lifting hooks 16. The lifting hooks 16 are adapted to fit with corner castings (not illustrated) of a container, which are normally located in the corners of a container. As is seen in FIG. 2 the lifting hooks 16 are located at a vertical level which is below the vertical level of the horizontal beams 12. The lifting hooks 16 are arranged vertically below the underside of the lower one of the horizontal beams 12. The distance D in FIG. 2 is the distance from the ground 36 to the underside of the lower horizontal beam 12. The underside of the horizontal beam 12 is the side facing the ground 36.

A container support surface 20 is arranged at a lower end portion 22 of each vertical container holding beam 14. The container support surfaces 20 are arranged to abut onto the longitudinal sides of the container and thereby support the container and prevent the lower portion of the container from tilting towards the truck 2 when the container is lifted or handled.

Since the lifting hooks 16 are located below the main frame 10, and below the horizontal beams 12, the operator of the truck 2 will have a free view of the lifting hooks 16, in particular at high lifting highs. In comparison with prior art side lift spreaders having lifting hooks arranged above the horizontal beams, it is realized that the inverted side lift spreader 1 will allow the driver of the truck 2 to get a better view of the lifting hooks at high lifting height.

Due to the construction of the inverted side lift spreader 1, which will be described in more detail below, the lower end of the mast 4 of the truck 2 may be arranged vertically above the truck front axle 24 and the front wheels 26 of the truck 2, which is seen FIG. 2. However, the inverted side lift spreader 1 may also be arranged on a conventional truck having its mast arranged in front of the truck front axle and front wheels.

As described in connection to FIG. 1 above the spreader 1 comprises a main frame 10 which is movable with respect to a main carriage 8. The main frame 10 is held at the main carriage 8 by means of main frame guiding means 27 which comprises six links 28-33. The links 28-33 will be described with reference to FIG. 5 below. Further, a side shift cylinder 34 is arranged at the underside of the main frame 10 and is attached to the main frame 10 in one end and to the main carriage 8 in the other. The purpose of the side shift cylinder is to power the side shift movement of the main frame 10 such that, for instance, an operator of the spreader 1 may align the spreader 1 to a container 6 that should be lifted, or to align a container on another container in a pile of containers. Side shift cylinders 34 are known in the art and will therefore not be described in detail here. A side shift cylinder is for instance shown at the side lift spreader in EP 0 701 964.

Figure 3:
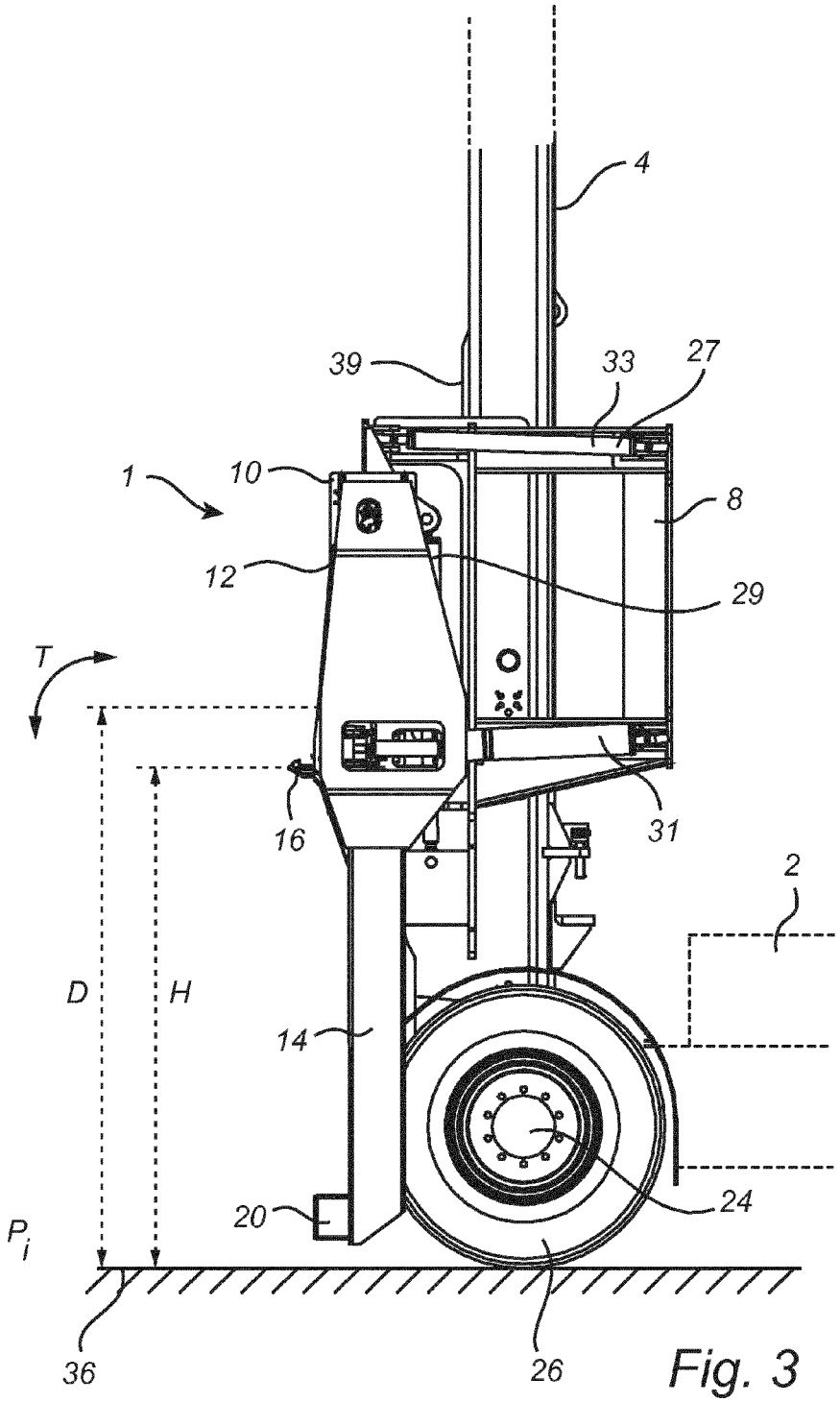
FIG. 3 is a side view of the side lift spreader in FIG. 2.

FIG. 3 shows the same spreader 1 as is illustrated in FIGS. 1 and 2. The spreader in FIG. 3 is arranged at a mast of a truck 2 and is in a position which will be referred to as the lowest working position, or the initial position Pi, for the spreader 1 on the truck 2. It is realized that FIGS. 1-5 all illustrate the spreader 1 in the initial position $P_i$. A container which is to be handled in the lowest working position is located directly on flat ground 36.

If FIG. 3 is studied together with FIG. 2 it is realized that the entire telescopic beams 12 are located above the lifting hooks 16 for the inverted side lift spreader 1. Thus, referring to a standard container 6 as the one illustrated in FIG. 1, the distance D from the ground 36 to the underside of the lowest one of the two telescopic beams 12 is larger than the height of the container 6. Thus, the distance D from the ground 36 to the underside of the lowest one of the two telescopic beams 12 is larger than the distance from the ground 36 to the lifting hooks 16. The support surfaces 20 are arranged vertically below the lifting hooks 16 in order to support a container at a lower portion 36 of the container.

In the initial position $P_i$, as well as in all other container lifting positions of the inverted side lift spreader 1 illustrated here, the main carriage 8 of the spreader 1 is located vertically above the front axle 24 of the truck 2. This is possible since the horizontal beams 12 are located at a vertical level which is above the level of the front wheels 26 of the truck 2, in the lowest working position i.e. the initial position $P_i$. In other words, the front wheels 26 of the truck 2 will never be obstructed by the horizontal beams 12 since the lowest working position for the horizontal beams 12 is above the front wheels 26 of the truck 2. The vertical container holding beams 14 are extended vertically downwards from the main frame 10. However, the vertical container holding beams 14 will not obstruct the front wheels 24 since the shortest container length for which the spreader 1 is adapted to lift is larger than the wheel track (i.e. the outer distance between the front wheels 26).

Since FIG. 3 is a side view of the inverted side lift spreader 1 only three 29, 31, 33 links of the six links 28-33 in the main frame guiding means 27 are seen.

Figure 4:
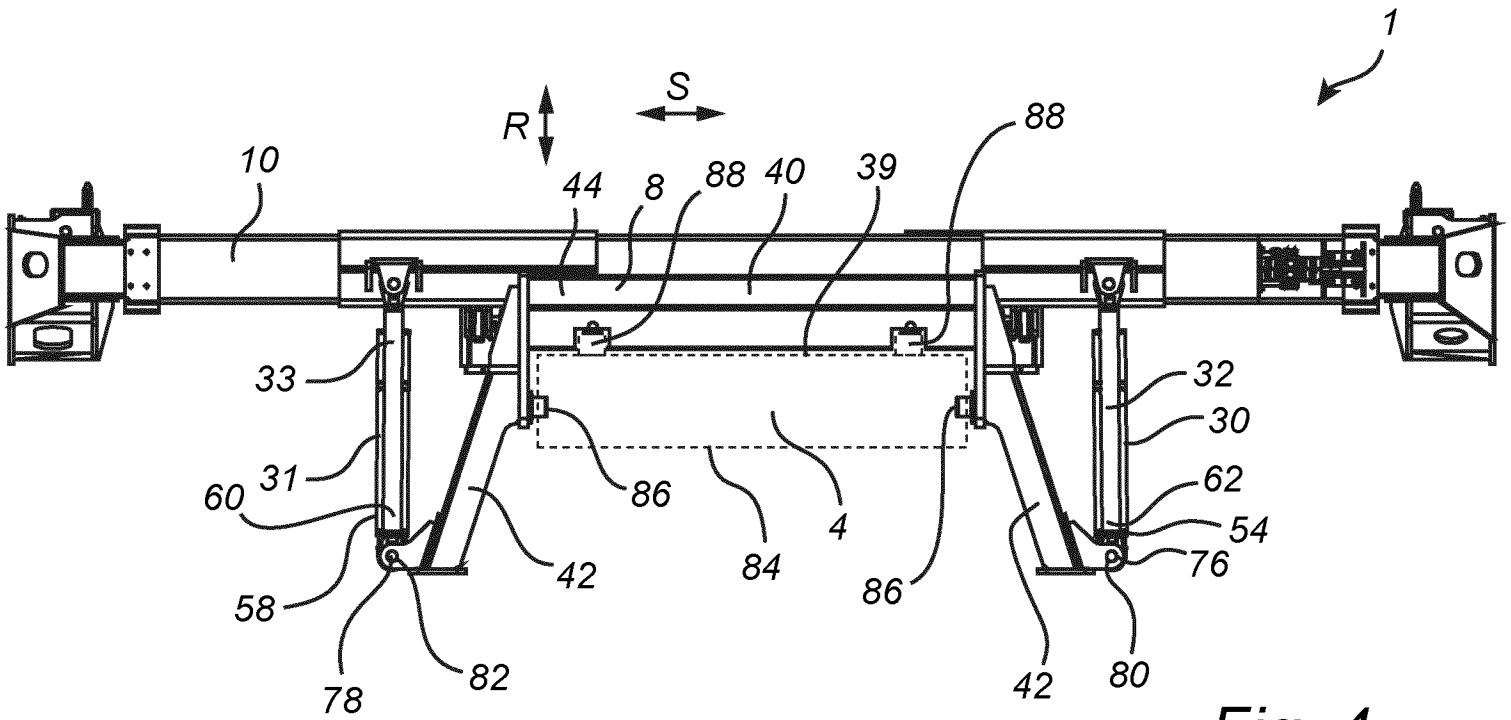
FIG. 4 is a perspective view of the side lift spreader in FIG. 2.

FIG. 4 shows the inverted side lift spreader 1 of FIGS. 1-3 from above. FIG. 4 shows no truck or container however the mast 4 of the truck is illustrated by dotted lines. A front side 39 of the mast is defined as the side of the mast 4 facing main carriage 10 and thus facing the container in use of the spreader 1. The front side 39 of the mast is indicated also in FIG. 2. The front side 39 of the mast 4 is provided with guides 88 which are known in the art. The guides 88 are used for guiding the main carriage 8 along the mast 4. A rear side 84 of the mast 4 is the side if the mast 4 opposite the front side 39. Thus, the rear side 84 of the mast 4 normally faces the operator of the truck.

The main carriage 8 is arranged on the mast 4 by conventional devices 86 for arranging a side lift spreader on a mast which are known in the art and not described here.

It is seen in FIG. 4 that main carriage 8, when viewed from above, is basically U-shaped having a base portion 40 and two legs 42. The base portion 40 of the main carriage is aligned parallel with the horizontal beams 12 of the main frame 10, when the spreader is in the initial position $P_i$ as in FIG. 4. The length of the base portion 40 is slightly longer than the width of the mast 4 in order for the legs 42, which are arranged at respective end portions 43 of the base portion 40, to surround the mast 4.

The four horizontally operating links 30, 31, 32, 33 will be described with reference to FIG. 4 however first all six links 28-33 constituting the main frame guiding means 27 will be described with reference to FIG. 5.

Figure 5:
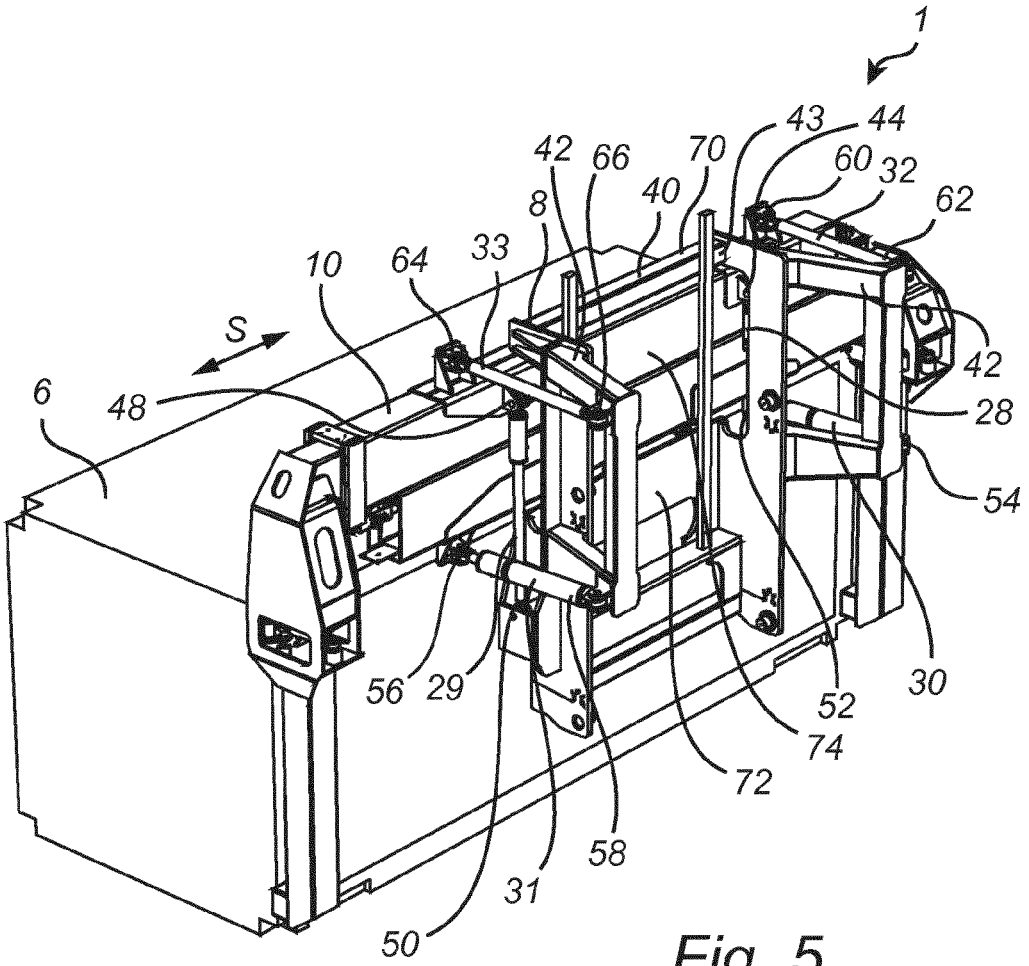
FIG. 5 is a top view of the side lift spreader in FIG. 2.

FIG. 5 shows the inverted side lift spreader 1 of FIGS. 1-4. For clarity purposes no truck or mast is shown in FIG. 5. The main frame 10 is connected to the main carriage 8 by means of four hydraulic cylinders 28, 29, 30, 31 and two rods 32, 33. The term "main frame guiding means" is used as common name for these hydraulic cylinders 28, 29, 30, 31 and rods 32, 33. The hydraulic cylinders and rods will also be referred to as "links" or "link arms"

The main frame 10 is supported and carried by two vertically operating cylinders 28, 29. The vertically operating cylinders 28, 29 may function, apart from carrying and supporting the main frame 10, as so called PPS cylinders (Powered Pile Slope). The function of the PPS cylinders will be described further below and from now on the cylinders 28, 29 will be referred to as PPS cylinders. One first portion 44, 48, which is an upper end portion, of each PPS cylinder 28, 29, is connected to the main frame 10. One second portion 46, 50, which is a lower end portion, of each PPS cylinder 28, 29, is connected to the main carriage 8 (the second portion 46 is hidden in FIG. 5). Thus the main carriage 8, which is held on the mast of the truck by known devices not illustrated here, carries the main frame 10 by means of the two PPS cylinders 28, 29. The PPS cylinders 28, 29 are mounted directly on the main frame 10, or on reinforcement on the main frame.

Four horizontal link arms 30, 31, 32, 33 of equal length extend in a horizontal plane. In the neutral initial position illustrated in FIG. 5 the link arms 30, 31, 32, 33 are essentially perpendicular to the horizontal telescopic beams 12. The link arms 30, 31, 32, 33 are arranged between the main frame 10 and the main carriage 8 to guide the movement of the main frame 10 with respect to the main carriage 8. One first portion 52, 56, 60, 64 of each link arm 30, 31, 32, 33 is mounted on the main frame 10. Each first portion 52, 56, 60, 64 is an end portion of the link arm 30, 31, 32, 33, respectively. One second portion 54, 58, 62, 66 of each link arm 30, 31, 32, 33 is mounted on the main carriage 8. Each second portion 54, 58, 62, 66 is an end portion of an opposite end of each link arm 30, 31, 32, 33 with respect to the first portion 52, 56, 60, 64, respectively.

Each first and second portion 52-66 of each link arm 30, 31, 32, 33 is pivotally mounted on the main frame 10 and main carriage 8, respectively. Thus, the link arms 30, 31, 32, 33 are pivotal and used for guiding the side shift movement of the main frame 10 with respect to the main carriage 8. The link arms 30, 31, 32, 33 in the embodiment illustrated here are parallelogram link arms, i.e. the link arms 30, 31, 32, 33 are arranged parallel to each other. The path of movement of the main frame 10 with respect to the main carriage 8, which is defined by the link arms 30, 31, 32, 33, thus follow an arc of a circle.

In the embodiment illustrated here the two lower link arms 30, 31 are hydraulic cylinders. The hydraulic cylinders 30, 31 may be used, apart from guiding the main carriage 10, for tilting the main carriage 10, which will be described below with reference to FIGS. 7*a-b*. The upper link arms 32, 33 illustrated here are rigid rods having the main purpose, apart from guiding the movement of the main frame 10, to prevent the container from tilting forwards. The tilt direction T is seen in FIG. 3. Even though the two upper link arms 32, 33 are illustrated as rigid rods it may be favourable, at least for improving tilt control of the spreader 1, if also the upper link arms 32, 33 would be hydraulic cylinders. Tilting would then be carried out by extending either the two lower 30, 31, or the two upper 32, 33 cylinders, and retract the other two cylinders. In the illustrated embodiment, where the lower two link arms 30, 31 are cylinders and the two upper link arms are rigid rods 32, 33, the point of attachments of the upper link arms 32, 33 is adapted to allow a tilting movement using a joint such as a ball joint.

The link arms 30, 31, 32, 33 have no driving power for the side shift movement. The side shift is powered by the side shift cylinder 34 (FIG. 2). By side shift is meant a sideways movement of the main frame 10 with respect to the main carriage 8 in a direction parallel with the length of a container 6 connected to the spreader 1. In FIG. 5 the side shift direction is illustrated by an arrow S.

Before returning to describe FIG. 4 it should be noted that it is shown in FIG. 5 that the base portion 40 of the main carriage 8 is divided into an upper base portion 70 and a lower base portion 72 and that the main frame 10 is arranged in a space 74 between the upper and lower base portions 70, 72 of the main carriage 8.

Returning now to FIG. 4. In order to provide space 75 for the link arms 30, 31, 32, 33 to guide the movement of the main frame 10, the legs 42 of the U-shaped main carriage 8 approach each other in a direction towards the base portion 40 of the main carriage 8. The above mentioned second portions 54, 58, 62, 66 of the link arms 30, 31, 32, 33 are mounted at the main carriage 8 at respective points of attachment 76, 78, 80, 82 which are located at a rear side 84 of the mast 2, when the inverted side lift spreader 1 is seen from above as in FIG. 4.

It is realized from FIG. 4 that, apart from the design and construction of the main carriage 8, the side shifting ability of the inverted side lift spreader 1 depends on the length of the link arms 30, 31, 32, 33. For instance it may be desirable to have a possible side shift movement of +−600 mm, which means that the main frame 10 is movable in total 1200 mm with respect to the main carriage 8. A suitable length of the link arms may then be between 500-3000 mm, preferably between 1000-2500 mm and most preferably between 1500-2000 mm.

A side shift movement of the main frame 10 guided by the link arms 30, 31, 32, 33 will result in a slight movement of the main frame 10 in the horizontal place, in a direction R perpendicular to the side shift direction S. With reference to FIG. 4, the described construction of the main carriage 8 having the space 74 between the upper base portion 70 and the lower base portion 72, allows a movement of the main carriage 8 in the direction R, which is shown in FIG. 5.

Both ends 52-66 of each link arm 30, 31, 32, 33 are mounted by means of pivotal joints such as ball joints on the main frame 10 and main carriage 8, respectively. Ball joints allow movement in all directions, which means that the link arms 30, 31, 32, 33, may guide a movement of side shift S and/or sideway leaning U of the main frame 10 with respect to the main carriage 8. This will be illustrated in FIGS. 6-7. FIGS. 6-7 show the same spreader 1 as in the previous drawings. For clarity purposes the truck and the container are not shown in FIGS. 6-7.

Figure 6A:
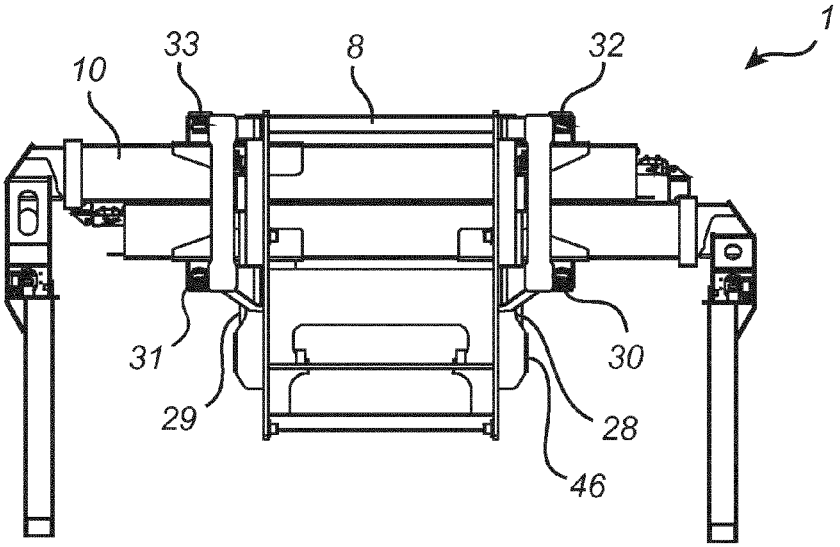
FIG. 6*a* is a rear view of the side lift spreader in FIG. 2 in an initial position.
Figure 6B:
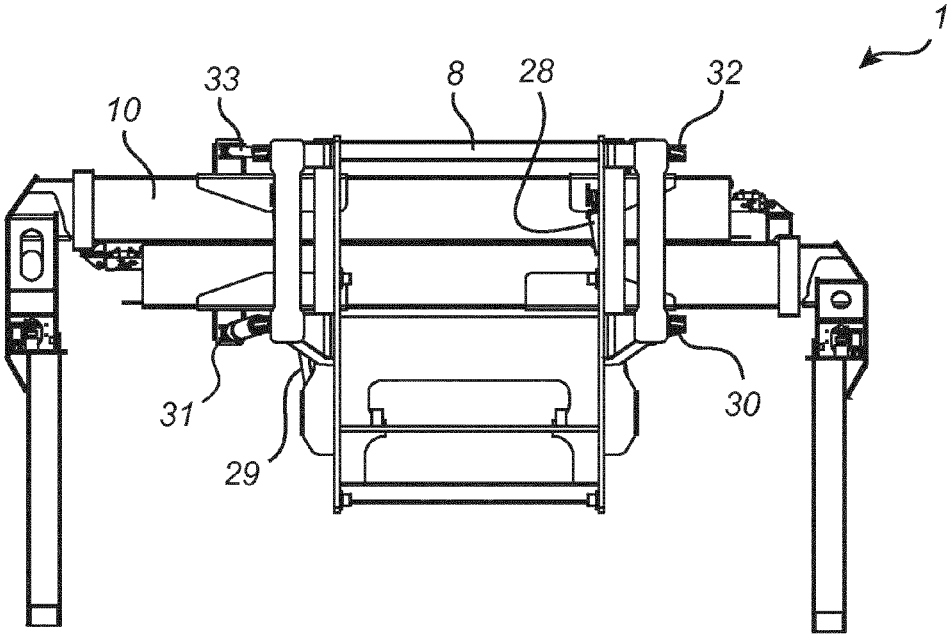
FIG. 6*b* is a rear view of the side lift spreader in FIG. 2 in a side shifted position.
Figure 6C:
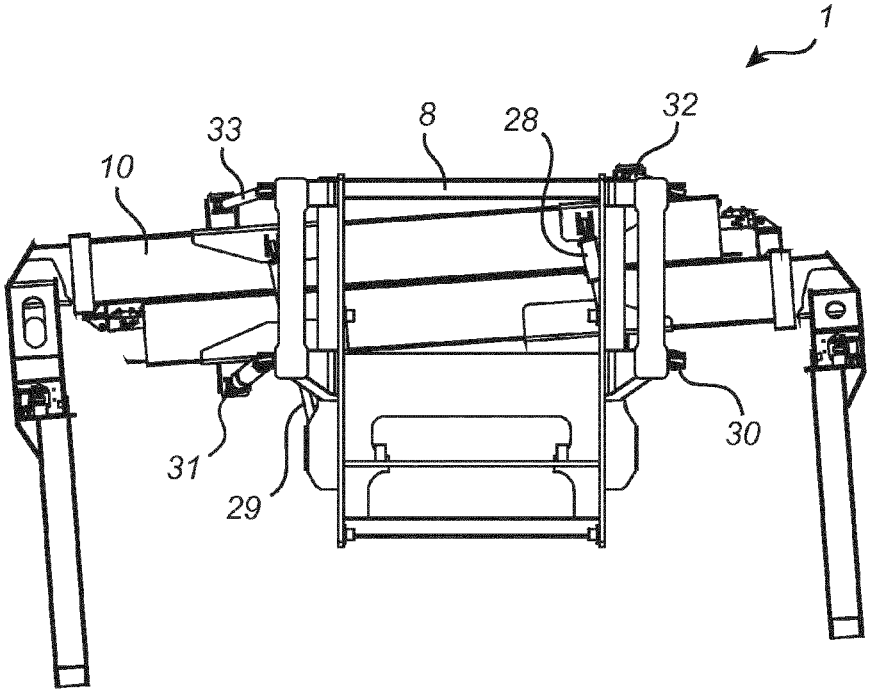
FIG. 6*c* is a rear view of the side lift spreader in FIG. 2 in a side shifted position.

FIGS. 6*a*-*c* illustrate the inverted side lift spreader 1 is three different positions. For clarity purposes no container or truck is shown in FIGS. 6*a*-*c*. FIG. 6*a* illustrate the spreader in the neutral initial position where the PPS-cylinders 28, 29 are vertically aligned and the link arms 30, 31, 32, 33 are essentially perpendicular to the main frame 10. In this position a container placed on flat ground may be handled by a truck on flat ground provided that the truck is centred with respect to the container.

FIG. 6*b* the main carriage 10 has been moved sideways towards the left as seen in FIG. 6*b* and as seen by the driver of the non-shown truck. The side shift movement is driven by the side shift cylinder 34 (FIG. 2) arranged below the main frame 10 and guided by the two PPS-cylinders 28, 29 and the four horizontal link arms 30, 31, 32, 33. The vertically operable PPS-cylinders 28, 29 are inclined towards the left as seen in FIG. 6*b*. FIG. 6*b* shows a side shift position which may be the maximum allowed side shift for the particular inverted slide lift spreader 1. In this position the PPS-cylinders 28, 29 are inclined about 6° with respect to a vertical axis. In order for the side shift to be allowed the PPS-cylinders need to be extended with respect to the position of the PPS-cylinders in the initial position $P_i$. If the PPS-cylinders would not be extended as a side shift movement is executed by the side shift cylinder 34, the main frame 10 would be lowered. Thus a control system (not illustrated) may be used for controlling the entire movement of the main frame 10, i.e. the PPS-cylinders and the side shift cylinder 34. If any of the link arms 30, 31, 32, 33 are controllable cylinders the control of those may be included in the not shown control system. In this position a container placed on flat ground may be handled by a truck on flat ground when the container has a location which is displaced about 600 mm to the left with respect to the truck.

In FIG. 6*c* the main carriage 10 has been moved sideways towards the left as seen in FIG. 6*c* and as seen by the driver of the non-shown truck. Moreover in FIG. 6*c* the main frame 10 has been articulated towards the left using the PPS cylinders 28, 29. In this position the right PPS-cylinder 28 is retracted whereas the left PPS-cylinder 29 is extended. In this position it is possible to handle a container which is not only displaced 600 mm to the left with respect to the ground, it is also compensated for an inclined ground.

As mentioned above the inverted slide lift spreader 1 allows the horizontal beams 12 to be arranged vertically above the truck front axle 24 and the front wheels 26 of the truck 2. It is realized that by such an arrangement the entire spreader 1 and container is located closer to the truck 2 than in prior art side lift spreaders. The centre of gravity for the truck 4 equipped with the inverted slide lift spreader 1 holding a container 6 is therefore moved towards the centre of gravity for the truck 2 itself, in comparison with a truck equipped with a prior art side lift spreaders holding a container. Thus, the inverted side lift spreader 1 gives stability advantages compared to prior art side lift spreaders.

Figures 7A, 7B:
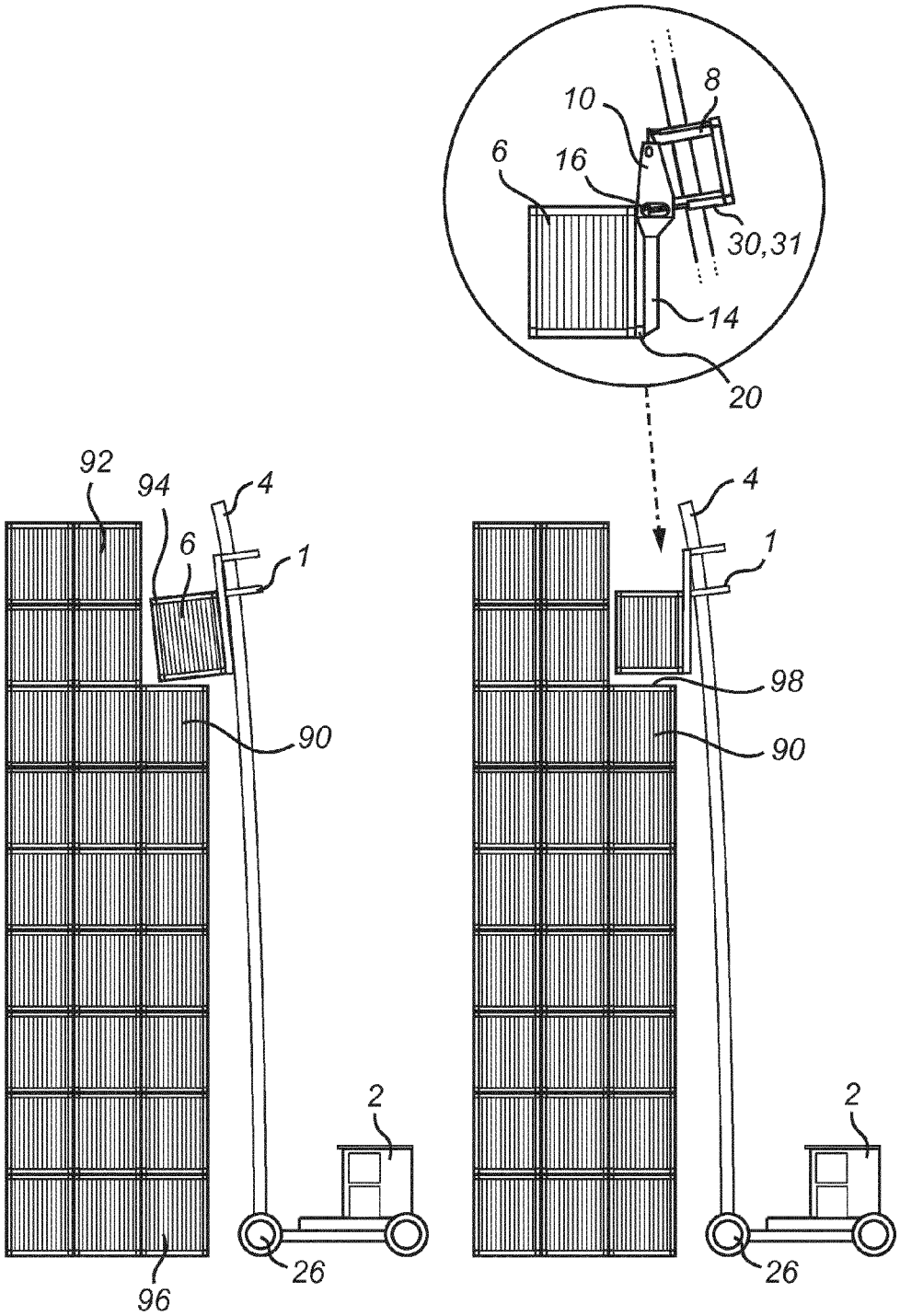
FIG. 7*a* is a side view of the side lift spreader in FIG. 1 handling an empty container.
FIG. 7*b* is a side view of the side lift spreader in FIG. 1 handling an empty container.

FIGS. 7*a*-*b* show the inverted side lift spreader 1 of FIGS. 1-6 in use for lifting a container 6 at high level. A first stack 90 of seven containers are stacked on top of each other and a truck 2 arranged with the inverted side lift spreader 1 is about to place another container 6 on the first stack 90. A couple of other container stacks 92 having 9 containers stacked on top of each other are arranged next to the first stack 90.

FIG. 7*a* illustrates how the mast 4 of the truck 2 is deflected forwards. As is seen in FIG. 7*a* it may be difficult to place the container 6 on the first stack 90 of containers as the deflecting mast 4 causes the upper forward corner 94 of the container 6 to hit the other stack of containers 92 and thus render a correct alignment of the container 6 on the first stack 90 of containers more difficult.

For prior art side lift spreaders it is known to compensate for a deflecting mast 4 by tilting the mast 4 towards the truck 2 (not illustrated). This may result in a better aligned container 6 however if will still be difficult to align the container on the first stack 90 of containers since the front wheels 26 of the truck 2 then may obstruct the bottom container 96 in the first stack 90 of containers.

FIG. 7*b* illustrates how the inverted slide lift spreader 1 is used for aligning the container 6 with the first stack 90 of containers without having to tilt the mast 4. The link arms 30, 31, which as described earlier are hydraulic cylinders, are used as tilt cylinders 30, 31. Thus, by activating the tilt cylinders 30, 31, the container 6 will be tilted clockwise as seen in FIGS. 8*a*-*b*. In this case the tilt cylinders 30, 31 are extended to tilt the container 6. Thereby the container 6 is aligned with the storage surface 98 which here is the upper surface of the upper container in the first stack 90 of containers. The container 6 may thus be arranged on the first stack 90 of containers without bumping into the other container stacks and without having the tilt the mast 4 of the truck 2.

Even though FIGS. 7*a-b* show a truck operating on flat ground it is realized that the problem with a deflecting mast would become even worse if the ground would be sloping towards the pile of containers.

The person skilled in the art realizes that the present invention by no means is limited to the embodiments described above. On the contrary, many modifications and variations are possible within the scope of the appended claims.

For instance, the support surfaces have been described as being located at the lower end portion of the vertical container holding beam. It is possible to have several support surfaces at each vertical container holding beam 14 or to have the support surface at a centre portion of a vertical container holding beam.

The four horizontal links 30, 31, 32, 33 have been described as parallelogram link arms. However different embodiments of the links are possible. The horizontal links 30, 31, 32, 33 could for instance be arranged such that their respective points of attachment on the main carriage 8 is located at a larger distance from each other than the points of attachment on the main frame 10. In addition the horizontal links 30, 31, 32, 33 could be arranged such that their respective points of attachment on the main carriage 10 are located at a smaller distance from each other than the points of attachment on the main frame 8. Such locations of the link arms 30, 31, 32, 33 would define a different path of movement for the main frame 10 with respect to the main carriage 8 than with the parallelogram link arms described here.

It has been described that the two lower links 30, 31 of the four horizontal links 30, 31, 32, 33 are hydraulic cylinders. It is however possible that all four horizontal links are hydraulic cylinders 30, 31, 32, 33. All cylinders which have been described as hydraulic cylinders may of course be powered in some other way than using hydraulic, such as using electric power.

It has been described that the two upper links 32, 33 of the four horizontal links 30, 31, 32, 33 are rigid rods. It is however possible that the two upper links are non rigid links such as wires, or that wires are used together with some support structure to prevent the upper portion of the main frame 10 from tilting towards the main carriage 8. Another suitable sort of link for one or several of the links may be a telescopic links.

Other lifting devices than a truck may be used.

Tilt cylinders are used for tilting a container support of the main frame 10 with respect to the main carriage 8. It is possible that one or several tilt cylinders are arranged at a different position than the once illustrated here. For instance, the support surfaces 20 may comprise tilt cylinders which may be used for tilting the container.

The inverted side lift spreader has been described in connection with an empty container. It is however realised that the container do not necessarily have to be empty. "Empty container" should be interpreted as a container having a total weight, i.e. the weight of the container and its contents, which the inverted side lift spreader or the lifting device is able to handle.

It has been described that PPS-cylinders are used as vertically operating cylinders. Other types of vertically operating cylinders may be used such as electrical cylinders or mechanical cylinders.

The disclosure hereinbefore relates to several inventions and inventive concepts, each of which may form the basis of a divisional application.

The invention claimed is:

1. A side lift spreader for handling empty containers, comprising a main carriage which is connectable to a lifting device to be movable along a front side of a mast of the lifting device, a main frame which is carried by and sideways movable with respect to the main carriage, and main frame guiding means for guiding a movement of the main frame with respect to the main carriage, wherein the main frame guiding means comprises at least two links, one first portion of each link being connected to the main frame and one second portion of each link being connected to the main carriage, wherein said second portions of the links are arranged at the main carriage at respective points of attachment which are located, in use of the spreader, at an opposite side of the mast compared to said front side.

2. The side lift spreader according to claim 1, wherein said links are pivotal links.

3. The side lift spreader according to claim 1, comprising at least three links.

4. The side lift spreader according to claim 1, comprising at least four links.

5. The side lift spreader according to claim 1, wherein said links are horizontally operating links.

6. The side lift spreader according to claim 5, wherein at least one of said links comprises a tilt cylinder operable for tilting the container.

7. The side lift spreader according to claim 1, comprising at least one vertically operating cylinder operable for adjusting the sideways leaning of the main frame with respect to the main carriage.

8. The side lift spreader according to claim 7, wherein the main frame is supported by said vertically operating cylinder .

9. The side lift spreader according to claim 1, comprising at least two vertical container holding beams which are arranged to the main frame, wherein each vertical container holding beam comprises a container locking device and a lower container support, wherein the lower container support is arranged at a longer vertical distance from the main frame than the container locking device.

10. A method for adjusting a main frame of an inverted side lift spreader with respect to a main carriage of the inverted side lift spreader, comprising supporting the main carriage at a mast of a lifting device;

supporting the main frame movably at the main carriage; and guiding a movement of the main frame with respect to the main carriage using main frame guiding means comprising at least two pivotal links, wherein a first portion of each link is connected to the main frame and a second portion of each link is connected to the main carriage, wherein said second portions of the links are arranged at the main carriage at respective points of attachment which are located at an opposite side of the mast compared to a front side, along which the main carriage is movable.

11. The method according to claim 10, wherein said movement is a sideway translation of the main frame with respect to the main carriage.

12. The method according to claim 10, wherein said movement is a sideway leaning of the main frame with respect to the main carriage.

* * * * *